US008757455B2

(12) United States Patent
Smalley

(10) Patent No.: US 8,757,455 B2
(45) Date of Patent: Jun. 24, 2014

(54) PADDLE HOLDER FOR A WATERSPORT ARTICLE AND METHOD

(75) Inventor: John William Smalley, Kula, HI (US)

(73) Assignee: John William Smalley, Kula, HI (US)

( * ) Notice: Subject to any disclaimer, the term of this patent is extended or adjusted under 35 U.S.C. 154(b) by 196 days.

(21) Appl. No.: 13/159,194

(22) Filed: Jun. 13, 2011

(65) Prior Publication Data

US 2012/0312852 A1 Dec. 13, 2012

(51) Int. Cl.
*A45F 5/00* (2006.01)
*A41D 7/00* (2006.01)

(52) U.S. Cl.
USPC ..... 224/250; 2/67; 224/254

(58) Field of Classification Search
USPC ..... 224/269, 182, 184, 191, 666, 660, 661, 224/663, 665, 250, 934, 148.5, 148.1, 578, 224/194, 197, 217, 218, 222, 671, 674, 401, 224/241; 2/67, 271, 69, 265, 238, 227, 228, 2/249, 250, 251, 300; 294/149, 150; 24/3.1, 3.2, 3.9, 115 H, 3.13, 298, 302; 441/74
See application file for complete search history.

(56) References Cited

U.S. PATENT DOCUMENTS 3,165,091 A * 1/1965 Welton ..... 119/805
4,599,750 A * 7/1986 Rahaman ..... 2/243.1
5,421,032 A * 6/1995 Murphy ..... 2/67
5,634,215 A * 6/1997 DeBaene ..... 2/227
5,697,128 A * 12/1997 Peregrine ..... 24/115 G
6,776,317 B1 * 8/2004 Parker ..... 224/251
6,964,361 B2 * 11/2005 Kathrein ..... 224/183
7,103,943 B2 * 9/2006 Lambert ..... 24/298
7,343,647 B1 * 3/2008 Kinskey et al. ..... 24/3.13
7,950,070 B2 * 5/2011 Beven ..... 2/235
2001/0035440 A1 * 11/2001 Danielson ..... 224/149
2003/0111496 A1 * 6/2003 Abbott ..... 224/148.6
2004/0099705 A1 * 5/2004 Skupin ..... 224/674
2004/0112377 A1 * 6/2004 Amarasinghe et al. .. 128/201.22
2006/0206986 A1 * 9/2006 Straiton ..... 2/238
2008/0169688 A1 * 7/2008 Funderburg ..... 297/188.06
2009/0083947 A1 * 4/2009 Kubli ..... 24/115 H
2010/0083422 A1 * 4/2010 Lebl ..... 2/251

* cited by examiner

*Primary Examiner* — Justin Larson
*Assistant Examiner* — Phillip Schmidt
(74) *Attorney, Agent, or Firm* — Wells St. John P.S.

(57) ABSTRACT

A paddle holder is provided for a watersport article. The paddle holder includes a clothing element, an anchor, and a lanyard. The clothing element is configured to be integrated into a watersport article along a lateral location of a user elevationally between a supra-patellar region and an abdominal region. The anchor is affixed to the clothing element. The lanyard has a retention device and an adapter. The adapter is configured to affix to the anchor on the clothing element. The retention device is configured to mate and demate with a handle of a paddle to retain the paddle to the clothing element. A method is also provided for retaining a paddle with a watersport article.

30 Claims, 14 Drawing Sheets

PADDLE HOLDER FOR A WATERSPORT ARTICLE AND METHOD

TECHNICAL FIELD

The present invention pertains to clothing articles. More particularly, the present invention relates to retainers for clothing articles for removably securing items, such as watersport accessories, to the article when swimming with an accessory, such as a paddle.

BACKGROUND

Lanyards are known for securing key chains within pockets of pants and jackets. Additionally, lanyards are known for affixing wax combs within pockets of surfboard shorts. Improvements are needed for removably securing watersport accessories to a watersport enthusiast that is placed in a situation where they are required to swim with the accessory, while minimizing any restriction of the ability of the user to swim, particularly while swimming towards an untethered or detached board or while swimming to shore.

SUMMARY OF THE DISCLOSURE

A retainer is provided for securing a watersport accessory to a clothing article to facilitate a user swimming to shore with the accessory. For example, a paddle can be secured to a loop that is affixed to swimwear, such as a pair of shorts, a body suit, a water t-shirt or rash guard top, or a wetsuit at a location that facilitates swimming with the paddle.

According to one aspect, a watersport clothing article and paddle holder is provided having a clothing element, an anchor, and a lanyard. The clothing element is provided on a lateral location of a user elevationally between a supra-patellar region and an abdominal region. The anchor is provided on the clothing element. The lanyard has a loop and a fastening. The loop is adjustably sized to be enlarged to receive an enlarged head of a paddle and ensmalled after being received over the head of the paddle to entrap the paddle within the loop. The fastening is secured to the anchor.

According to another aspect, a paddle holder is provided for a watersport article. The paddle holder includes a clothing element, an anchor, and a lanyard. The clothing element is configured to be integrated into a watersport article along a lateral location of a user elevationally between a supra-patellar region and an abdominal region. The anchor is affixed to the clothing element. The lanyard has a retention device and an adapter. The adapter is configured to affix to the anchor on the clothing element. The retention device is configured to mate and demate with a handle of a paddle to retain the paddle to the clothing element.

According to yet another aspect, a method is provided for retaining a paddle with a clothing article. The method includes: providing a paddle and a clothing article having a clothing element situated on a user at a lateral location, having a lanyard carried by an attachment anchor that is affixed to the clothing element, the lanyard having a coupling device for releasably retaining a terminal end of a paddle; securing the lanyard to the paddle proximate a distal handle end of the paddle; and tethering the paddle with the lanyard to the clothing article while swimming.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Preferred embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Recently, stand-up paddle surfing, or paddleboarding has exploded in popularity. Although this watersport borrows many traits from other sports, such as surfing, outrigger canoe paddling and kayak paddling, this new sport presents some unique challenges. First, users or paddlers are typically attached to a board with a leash, but the leash can break and the board can drift away from the user due to winds and/or waves. Secondly, a user can be paddling without use of a leash, and the board can drift away from the user due to wind and/or waves. In these situations, a user is faced with swimming to a board, or swimming to land with a paddle. It can prove difficult, particularly for a first time user, to swim with a paddle and they can struggle to make efficient headway in the water. A retainer is provided for solving this problem in order to mitigate risk of personal injury or equipment loss. It should be noted that other watersports that use a paddle and involve a user that might have to swim with a paddle also present a similar problem that can be resolved as set out below FIGS. 1-3 and 5-7 illustrate an example of a suitable watersport accessory retainer 11 having a lanyard 10 provided on a watersport clothing article, or surf shorts 18. Retainer 11 enables a user to swim efficiently, in a fast and less tiring manner, back to safety, rather than transporting the paddle 14 by hand. As a result, there is less risk of losing a relatively expensive paddle, or having to make a decision to leave the paddle in order to swim to safety. For cases where a user swims back to a board, the user then arrives back at the board with the paddle, and is then better able to paddle back to shore. In one case, paddle 14 is a paddleboard paddle. In another case, paddle 14 is a canoe paddle. Furthermore, it is envisioned that other forms of paddles or oars can be retained with such a device, as well as further watersport accessories.

Figure 1:
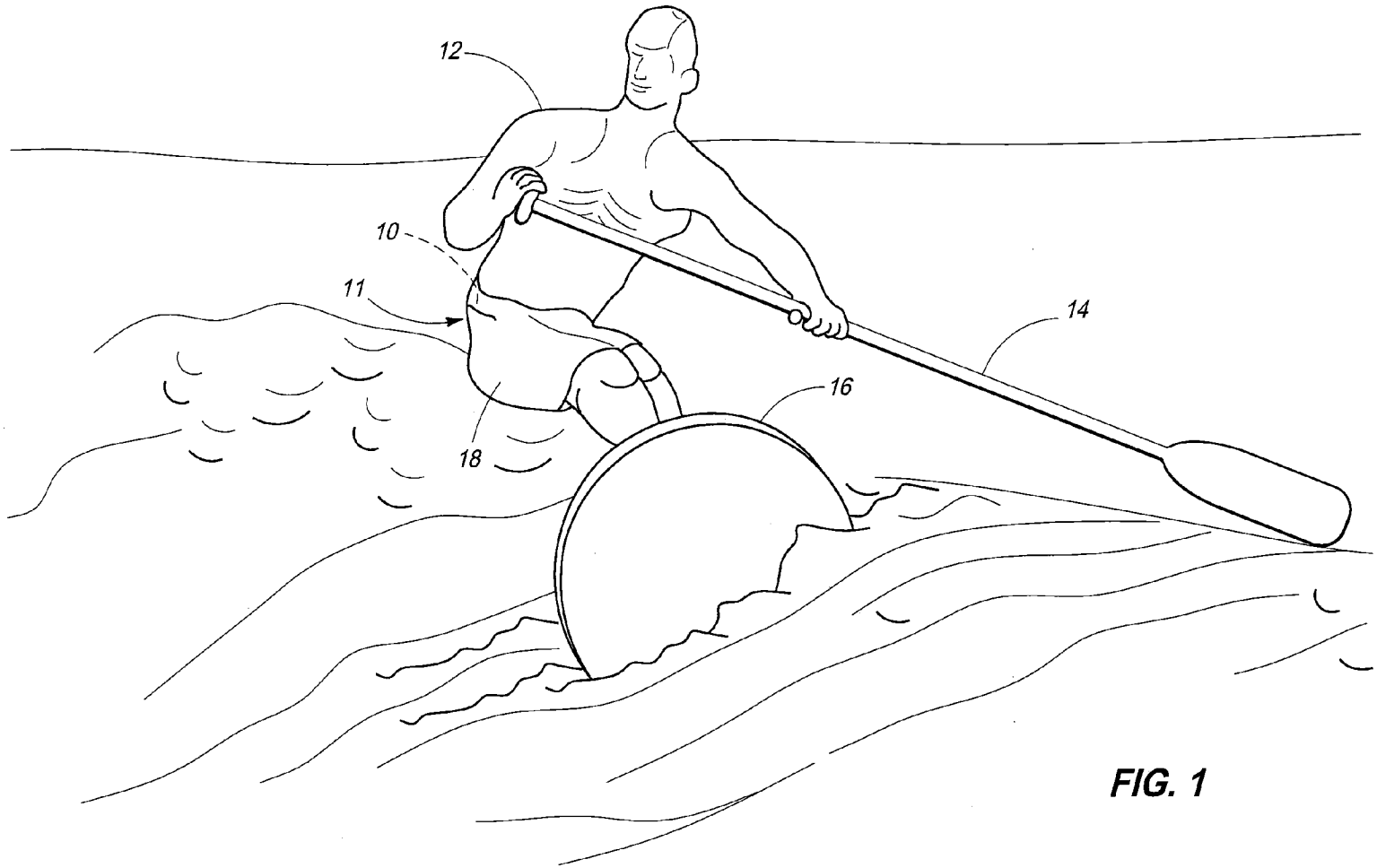
FIG. 1 is a simplified perspective view illustrating a user of a surfboard and a paddle actively paddleboarding, with the user wearing a watersport clothing article having a surfboard paddle retainer according to a first embodiment.

As shown in FIG. 1, an individual user 12 is shown riding a paddleboard, or surfboard 16 while wearing shorts 18 and handling a paddle 14. User 12 actively uses paddle 14 while riding board 16 through waves and surf. User 12 is wearing watersport clothing article 18 with retainer 11 so that in the event user 12 is capsized, paddle 14 can be secured to retainer 11 via lanyard 10 while user 12 is swimming with paddle 14 in order to either retrieve board 16, or to swim to safety.

Figure 2:
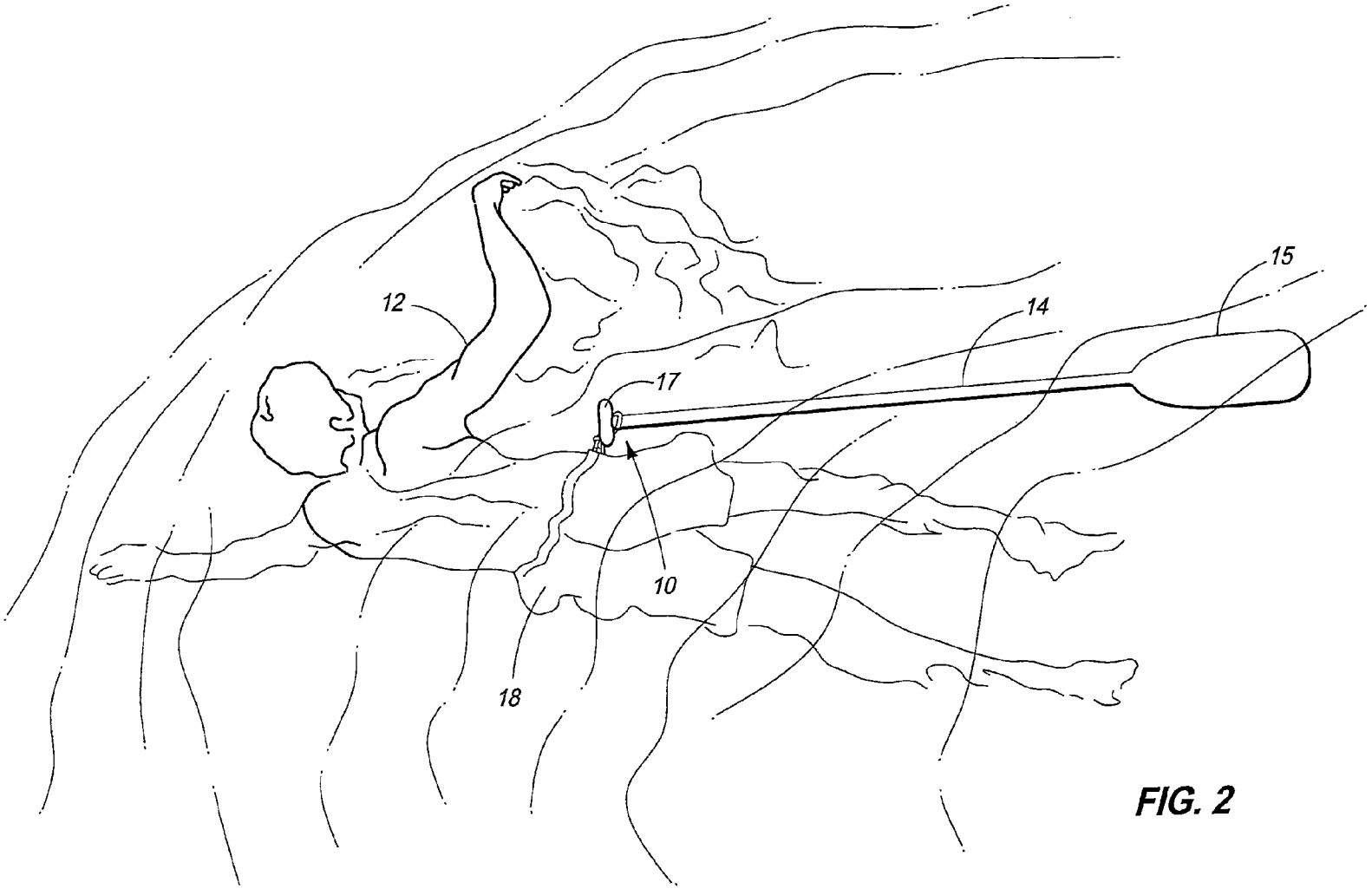
FIG. 2 illustrates the user of FIG. 1 after being separated from the surfboard and while retaining the paddle, as the user swims with the paddle.

FIG. 2 illustrates user 12 swimming after securing paddle 14 with retainer 11 to shorts 18. In this situation, user 12 has been separated from board 16, and user 12 is better able to swim while towing paddle 14. Lanyard 10 of retainer 11 has been secured by hand over handle 17, such that blade 15 is disposed distally from user 12 as user 12 swims with paddle 14 in tow, providing an efficient slipstream condition as paddle 14 glides alongside user 12. Providing retainer 11 on a lateral location of user 12 elevationally between a supra-patellar region and an abdominal region provides for a more efficient stowage position while swimming, reducing interaction of paddle 14 with limb and joint motion of user 12 while swimming. It is understood that such a mounting position for retainer 11 can be provided on either a left side, a right side, or both sides of a user, and can include multiple mounting locations within such region. Such region has been found to minimize any incident of a user kicking a paddle while the paddle is retained to a user's watersport clothing article.

Figure 3:
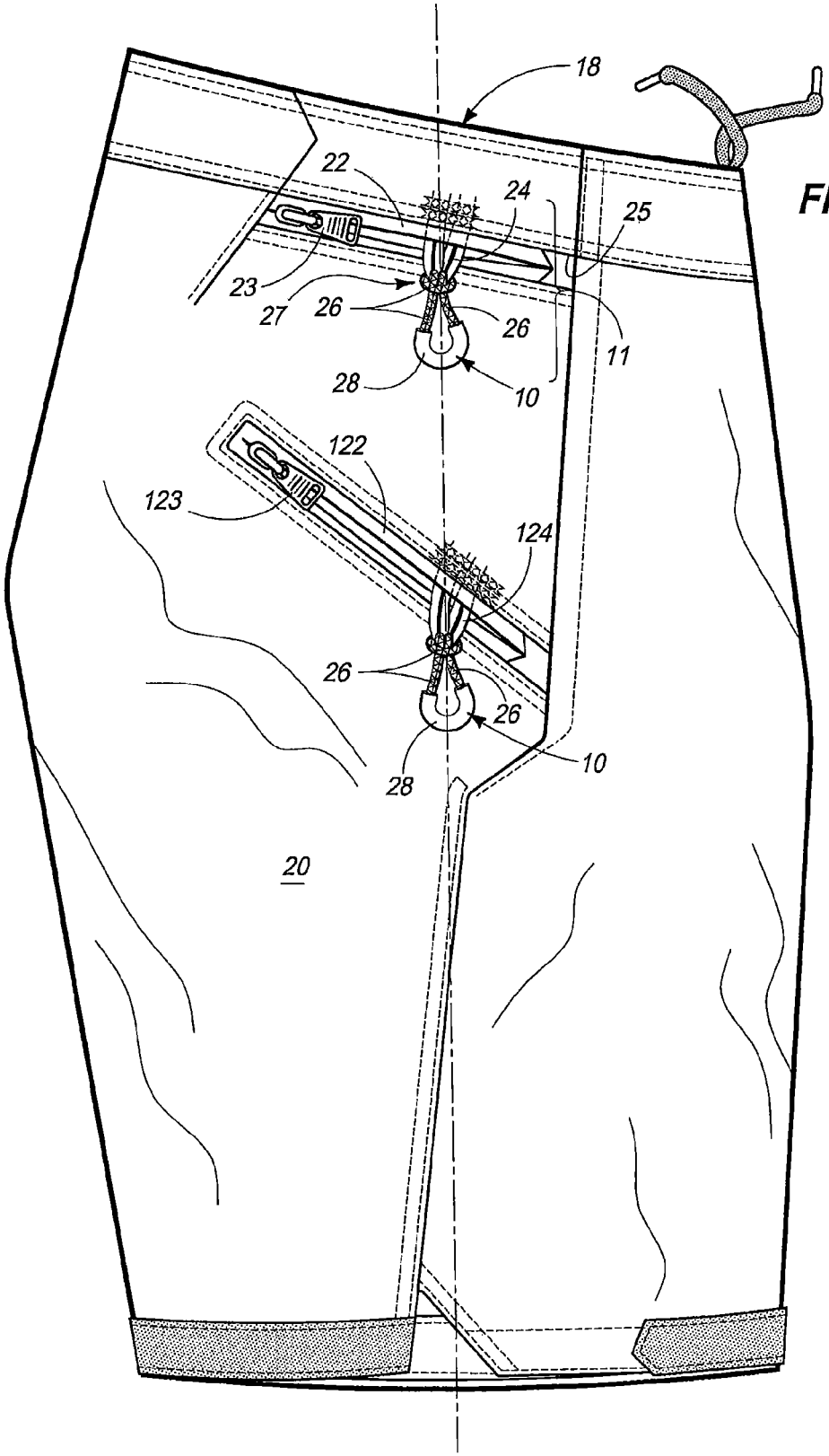
FIG. 3 is right side elevational view of the watersport clothing article of FIGS. 1 and 2 in the form of a pair of shorts.

FIG. 3 is right side elevational view of a watersport clothing article in the form of a pair of surf, or paddleboarding shorts 18 having two distinct lanyards 10 shown retrieved from within pockets 22 and 122, respectively, where they are stowed when not in use. For example, lanyard 10 is attached to a clothing web anchor 24 that is sewn to a waistband seam 25 on shorts 18. Lanyard 10 and anchor 24 combine to provide retainer 11. Anchor 24 extends through a zipper 23 outside of pocket 22 where an elastic cord loop 26 is affixed to anchor 24 with a luggage tag, or cows hitch knot, or self-loop knot 27. Anchor 124 is similarly extends through a zipper 123 of a pocket 122 where it is sewn, or bar-tacked to a top edge zipper seam within pocket 122. A second lanyard 10 is similarly affixed to anchor 124 with a cows hitch or similar knot. In one case, lanyard 10 can be a single lanyard that is moved between anchors 24 and 124, according to preferences of the user. Optionally, two lanyards 10 can be provided, one for each anchor 24 and 124. In one case, anchors 24 and 124 are formed from a web of sewn fabric material. In another case, anchors 24 and 124 are formed from any suitable web or loop material, such as any fabric tape, metal, neoprene, rubber, rope, membrane, or composite material.

Figure 5:
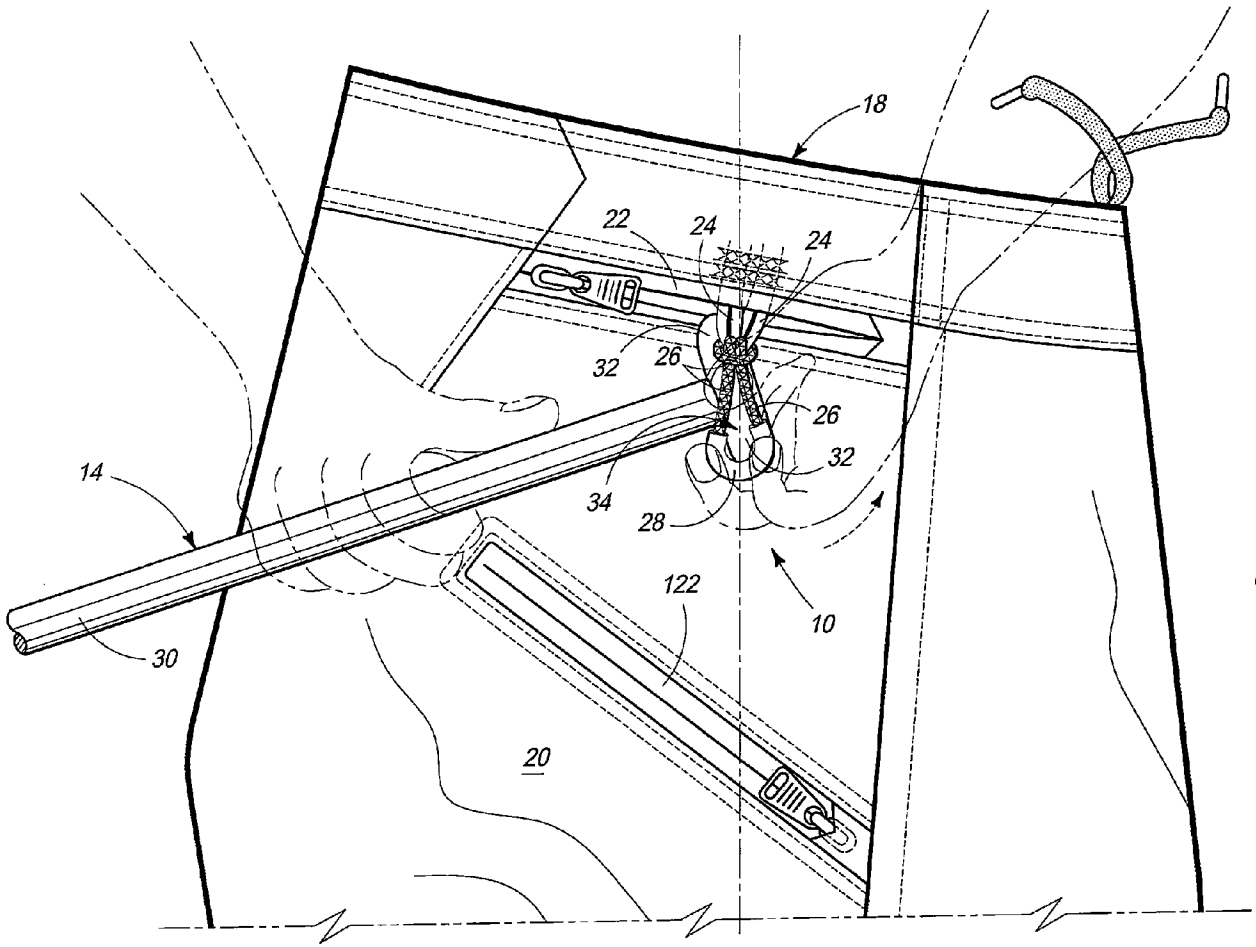
FIG. 5 is an enlarged partial right side elevational view illustrating a paddle handle being manipulated by a user for retention within a lanyard loop on the watersport clothing article of FIGS. 1-3.

As shown in FIG. 3, lanyards 10 are each constructed from a loop of elastic shock cord 26 with ends formed within an arcuate, tubular rubber stiffening member 28 that holds open a loop formed in lanyard 10, while also providing a tactile surface for a user to facilitate manipulation and expansion of the resulting loop when loading a paddle handle through the loop (see FIG. 5). Optionally, lanyard 10 can be made from any of a number of different elastic materials, such as rubber, or any of a combination of flexible and non-flexible materials, like high molecular-weight polyethylene (HMWPE) lines, aramid lines, or high modulus lines.

According to FIG. 3, clothing element 20 of shorts 18 is provided on a lateral location of a user elevationally between a supra-patellar region and an abdominal region for attachment of anchors 24 and 124, respectively. Such region is provided to minimize leverage against a user's body while swimming and while connected to a paddle, so as to minimize the paddle impeding a user while swimming. In one case, it has been found desirable to provide a defined distance between the paddle handle and a user through the retainer so that the paddle handle is engaged close to the body of the user but not engaged tightly against the body of a user, which can otherwise restrict ability of a user to swim with an attached paddle. In another case, it has been found desirable to ensure the distance from the paddle handle and the body of the user is sized so as to avoid the paddle digging into the user's body while swimming. This distance can be controlled by considering the choice of fabric being used, and considering the specific positioning of the anchor on the watersport garment. In yet another case, it has been found desirable to have the paddle handle attached close enough to the body so that the paddle does not excessively interfere with the user while swimming.

In one case, clothing element 20 of FIG. 3 is a fabric element. Optionally, clothing element can be neoprene rubber, fabric membrane, or any other suitable structure for making panels that are integrated into watersport clothing articles. Although retainer 11 is shown on a pair of swimsuit shorts 18, it is understood that retainers depicted variously in FIGS. 1-21 can be provided on any form of worn apparel used in a watersport activity, such as wetsuits, shorty wetsuits, sunshirts, water-shirts, one-piece bathing suits, rash guards, fanny packs, and diving suits. Further optionally, retainer 11 can be affixed onto a paddle and removably attached onto an anchor on a clothing article.

Figure 4A:
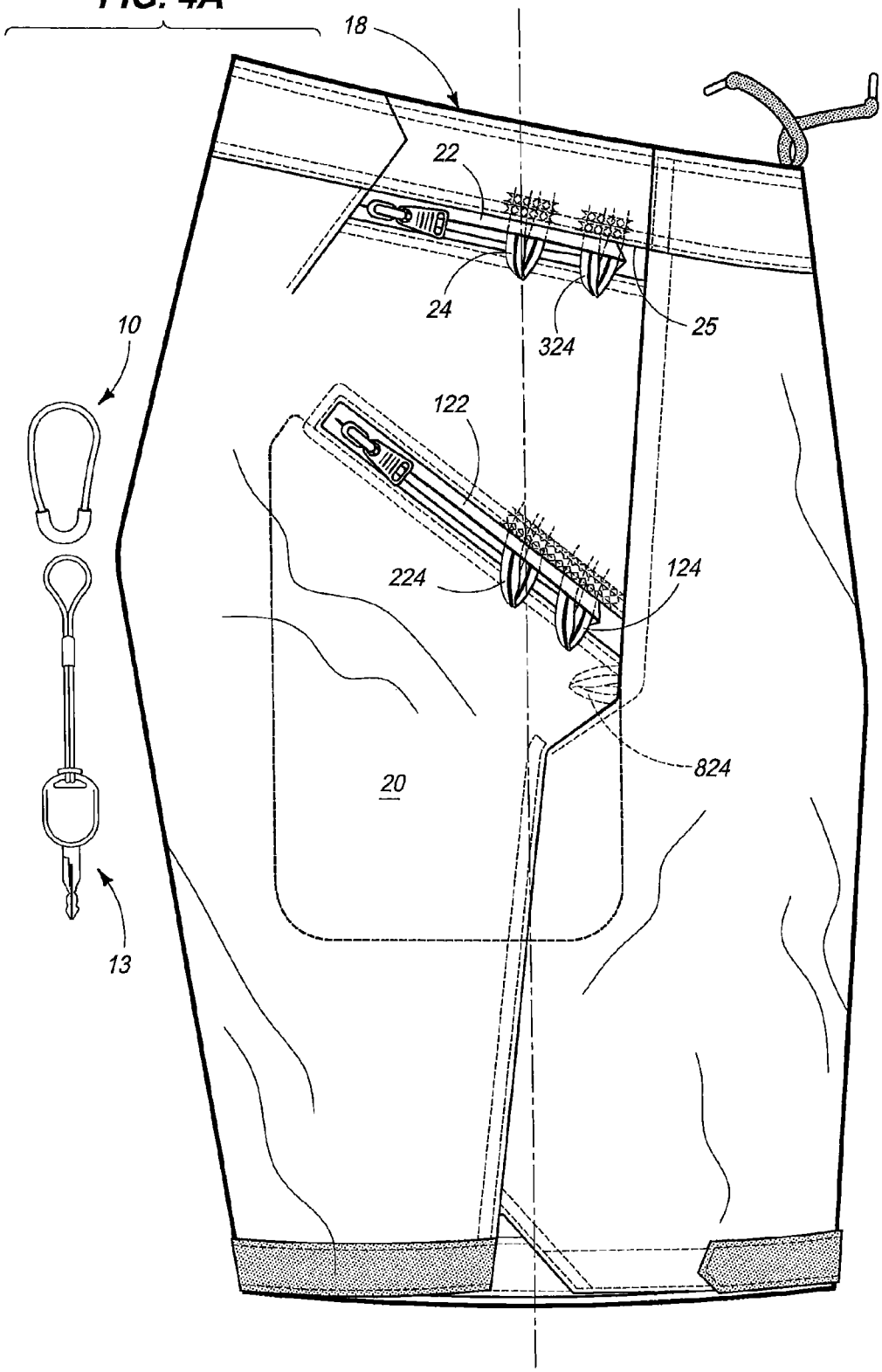
FIG. 4A is a right side elevational view of an optional configuration for the watersport clothing article of FIG. 3 illustrating multiple additional or optional anchor positions.
Figure 4B:
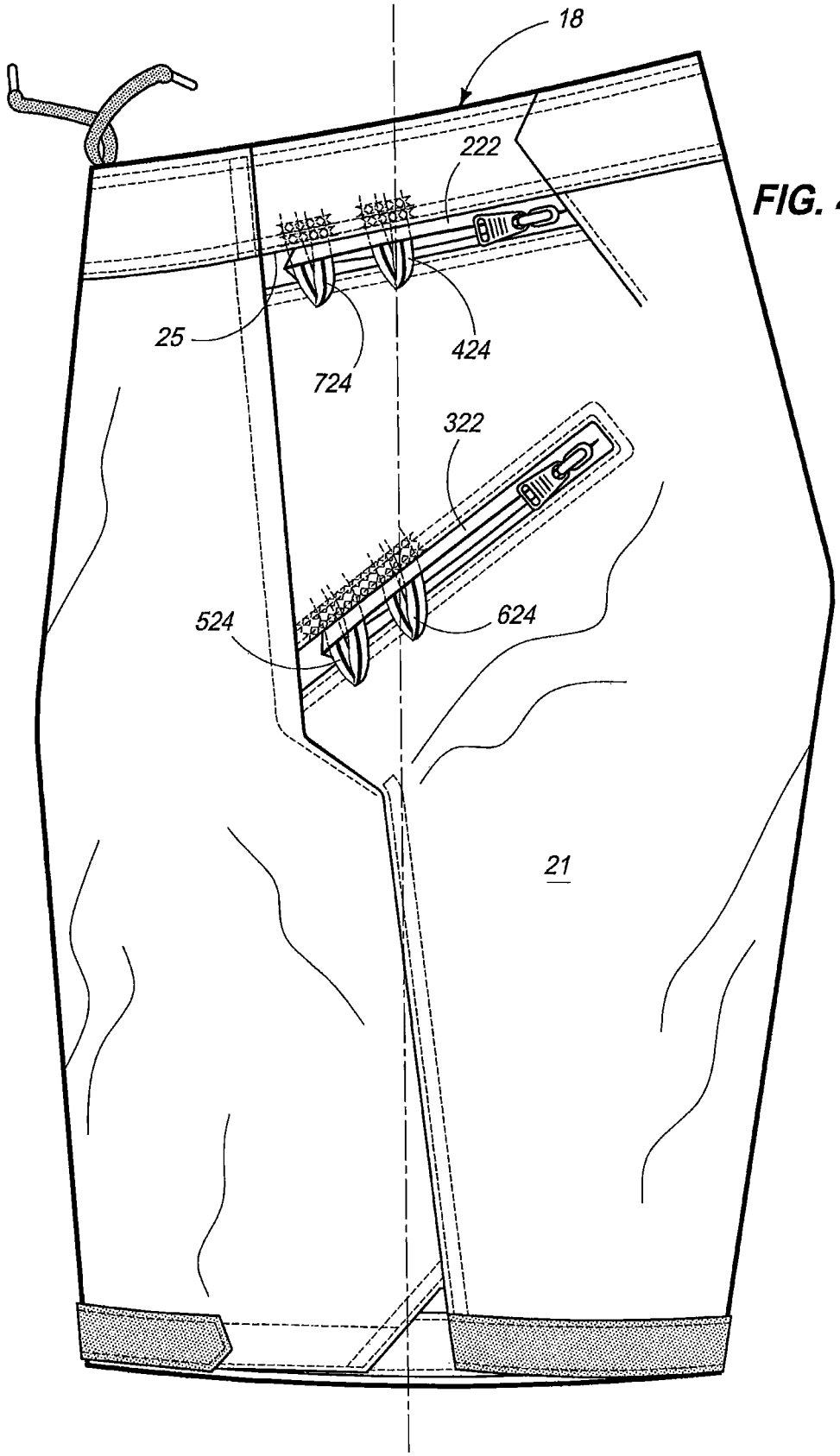
FIG. 4B is a left side elevational view of the watersport clothing article of FIG. 4A illustrating further additional or optional anchor positions.

FIGS. 4A and 4B together illustrate additional or optional locations for anchors 24, 124, 224, 324, 424, 524, 624, 724, and 824 along clothing panels 20 and 21 of shorts 18. FIG. 4A is a right side elevational view and FIG. 4B is a left side elevational view of an optional configuration for the watersport clothing article of FIG. 3 illustrating multiple optional anchor positions. In one case, all of anchors 24, 124, 224, 324, 424, 524, 624, 724, and 824 can be provided on a single pair of shorts, and a single (or multiple) lanyard, such as lanyard 10 or a key fob lanyard 13 can be moved between anchors based on user preference. Optionally, a single or multiple set of anchors can be provided on a single pair of shorts. Similarly, all or fewer than all of pockets 22, 122, 222, and 322 can be provided on shorts 18. When not in use, respective anchors are stowed within a respective pocket, either with an attached lanyard or without such lanyard. Anchor 824 is sewn into a forward vertical seam of pocket 122.

As shown in FIG. 4A, a key chain fob lanyard 13 is constructed from a loop of elastic shock cord joined together with a molded rubber or plastic tubular retainer to form a pair of small and large end loops. One end loop is affixed to a key with a cows hitch, and an opposite loop is affixed to a selected anchor (such as anchor 824) with an opposed cows hitch, thereby securing a key to an anchor. In this manner, lanyard 10 and lanyard 13 can be interchangeably positioned on to anchor locations that are desired by a particular user.

FIG. 5 is an enlarged partial right side elevational view illustrating a paddle handle 32 being loaded into lanyard 10 of FIG. 3. More particularly, a user is hand-manipulating a distal end, or handle 32 of paddle 14 while stretching open elastic cord loop 26 to enlarge an aperture 34 by gripping and pulling stiffening member 28. Stiffening member 28 provides a tactile member affixed along a segment of the loop 26, such that a user can secure a paddle by finger-engaging the tactile member 28 to stretch open the loop 26 while inserting the distal handle end 32. Prior to retaining a watersport accessory, a user unzips zipper of pocket 22 and withdraws lanyard 10 from within, such that a cloth loop, or fabric loop of anchor 24 exits pocket 22 so that loop 26 is completely clear of pocket 22. Optionally, anchor 24 can be formed from any form of structural attachment, including synthetic webbing, metal loops, rubber loops, composite loops, or any other suitable form of structural attachment point. A user then manipulates paddle 14 and loop 26 to load handle 32 through an aperture 34 formed by elastic cord loop 26. Such operation can occur while a user is in the water, or while a user is standing or sitting on a board.

Figure 6:
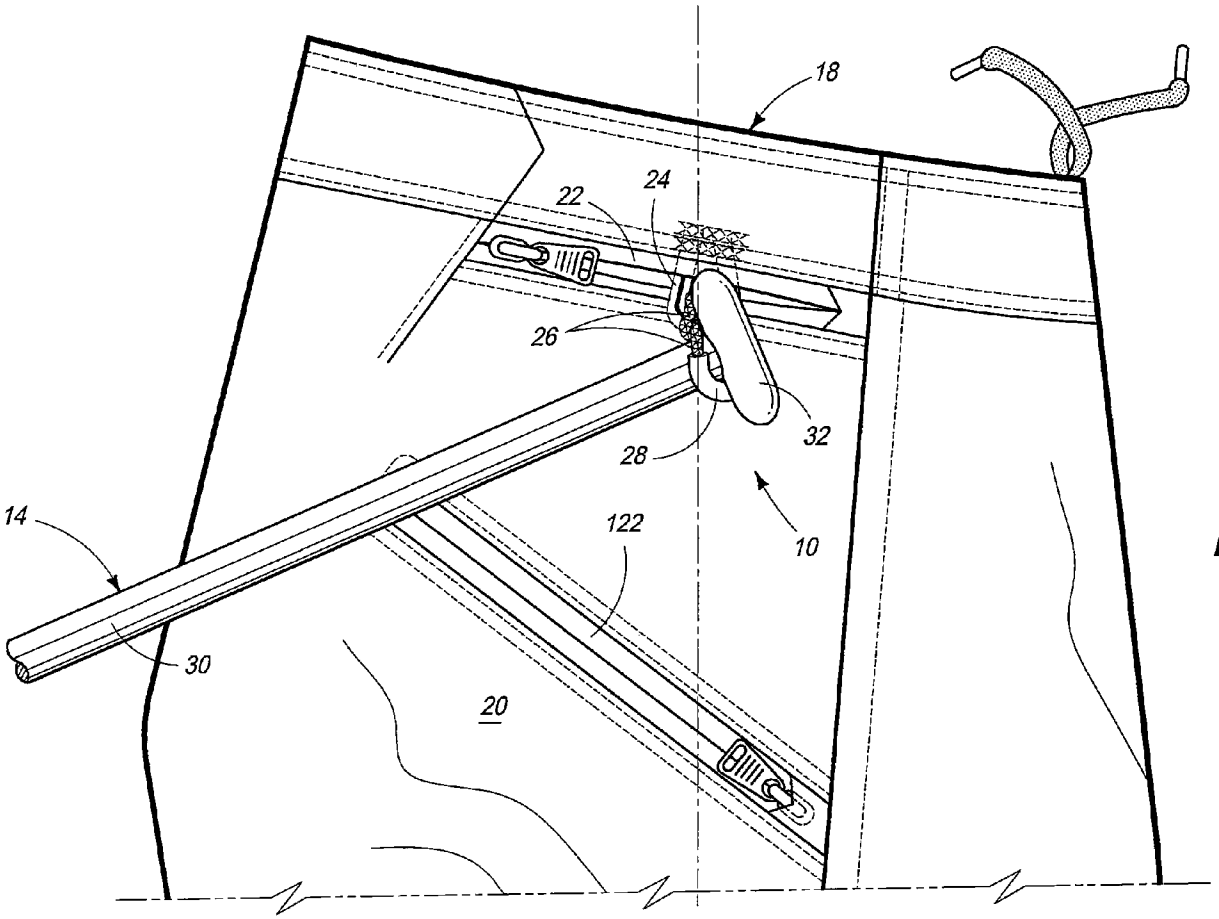
FIG. 6 is an enlarged partial right side elevational view taken later in time than that shown in FIG. 5 and illustrating a paddle handle fully retained within a lanyard loop on the watersport clothing article.

FIG. 6 is an enlarged partial right side elevational view taken later in time than that shown in FIG. 5 and illustrating paddle 14 secured by lanyard 10, as handle 32 is fully retained through elastic cord loop 26 on the watersport clothing article, or shorts 18. More particularly, when released by a user (after being stretched open), cord 26 tightens around shaft 30 of paddle 14, retaining paddle 14 via handle 32. Stiffening member 28, according to one construction, is formed from a tube of frictionable rubber material, which further ensures anchoring of paddle 14 within a loop of cord 26. In this retained configuration, a user can readily swim with paddle 14 being towed alongside a swimming user without losing paddle 14. However, in the event that it is necessary to quickly withdraw paddle from lanyard 10, elastic cord 26 will stretch in order to accommodate quick removal. Additionally or optionally, retainer 11 can be configured with a breaking strength that breaks under exceptional, or predetermined threshold loads in order to provide safety benefits. Optionally, anchor 24 can be designed to break at a predetermined threshold load.

As shown in FIG. 6, lanyard 10 provides a fastening having a coupling device in the from of a stretchable loop comprising a segment of elastic cord loop 26 for releasably retaining a terminal end 32 of paddle 14 to a watersport clothing article, such as shorts 18. Optionally, a coupling device can be provided by a releasable pin, such as a ball lock fastener, affixed to a lanyard that is secured to shorts and configured to engage and disengage with a complementary aperture in the handle of the paddle. Further optionally, a coupling device can be provided by a hook-and-loop fastener system, where a web loop of loop fastener material is encircled around shaft 30 and a complementary web strip of hook fastener material is affixed to an anchor on a watersport clothing article, or indirectly affixed to the clothing article via a cord.

Figure 7:
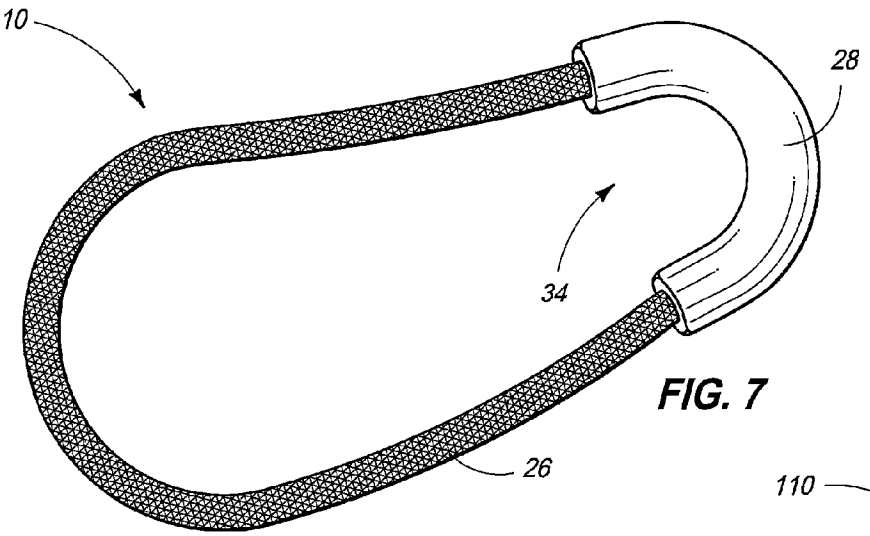
FIG. 7 is an unknotted plan view of an elastic loop lanyard with an arcuate stiffener member that is affixed onto the anchor points of FIGS. 1-6 with a self-formed cows hitch.

FIG. 7 is an unknotted plan view of elastic cord loop lanyard 10 used in FIGS. 1-6. Lanyard 10 is formed from a loop of elastic cord that has terminal ends butted together and molded together within an arcuate rubber tactile stiffening member 28. In addition to molding, glue and/or stitching may be used. In addition to securing together ends of cord 26, member 28 imparts an open loop, or aperture 34 to cord 26 at one end that forms a fastening and helps load a paddle handle there through. Furthermore, member 26 has a frictionable outer surface to facilitate tactile manipulation by a user's fingers when stretching cord 26 during insertion and removal of a paddle handle from a loop of lanyard 10. As shown in FIGS. 2-3 and 5-6, a cows hitch knot is formed in cord 26, opposite member 28 to secure lanyard 10 onto an anchor of a watersport clothing article. According to one construction, cord 26 is formed from elastic shock, or bungee cord having an exterior braided cover, such as polyester, nylon or polypropylene over interior strands of rubber, elastic material, elastane, or any natural or synthetic elastic fiber. Alternatively, any suitable stretchable cord, such as a rubber o-ring or surgical tubing, can be used to form cord 26.

Figure 8:
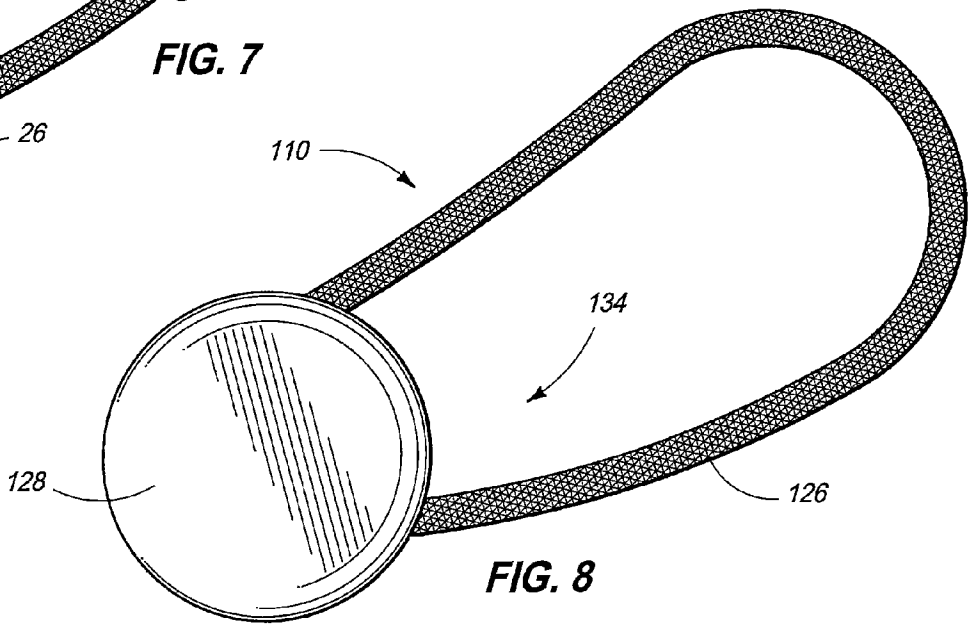
FIG. 8 is an optional construction lanyard having a plastic "puller-style" end connector.

FIG. 8 is an optional construction lanyard 110 having a plastic "puller-style" end connector 128 used to secure together opposed ends of elastic shock cord 126. Connector 128 also provides an open loop, or aperture 134 to cord 126 for facilitation insert and removal of a paddle handle there through, according to one construction. Optional constructions can restrict or eliminate any tendency to pre-form an aperture 134 in cord 126. According to one suitable construction, end connector is a NIFCO Twin Zipcord, available from NIFCO America Corp, Office for Nifco Group Buckle Business, □125 Baker St. E., Suite 115□Costa Mesa, Calif. 92626 U.S.A.

Figure 9:
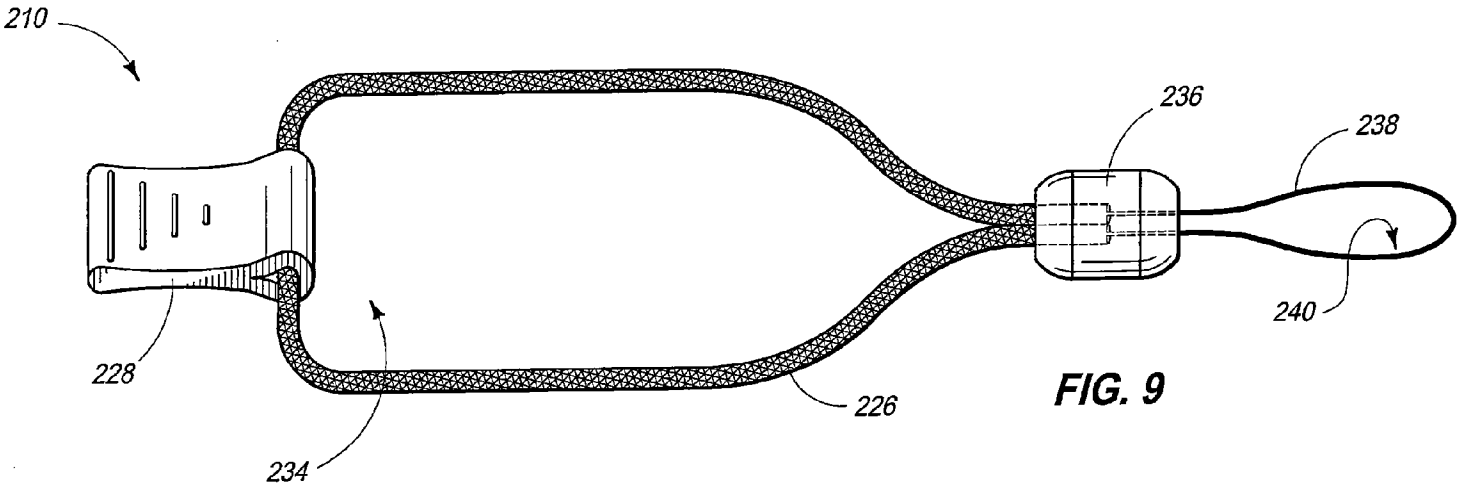
FIG. 9 is another optional construction lanyard having an elastic loop with a rubber molded "puller-style" stiffener member and an inelastic loop joined to the elastic loop with a molded rubber casing.

FIG. 9 is another optional construction lanyard 210 having an elastic shock cord loop 226 with a rubber molded "puller-style" stiffener member 228 and an inelastic loop 238 joined to the elastic loop 226 with a molded rubber casing 236. Member 228 is molded over elastic cord 226 so as to help hold open an aperture. or loop opening 234 in cord 226. Loop opening, or aperture 234 is provided for receiving and retaining a paddle handle and shaft, while a smaller aperture 240 is provided in inelastic loop cord 238, such as Spectra® polyethylene fiber rope, for forming a cows hitch knot to retain lanyard 210 to an anchor on a watersport clothing article. Spectra® is a Federally registered trademark of Allied Corporation, Columbia Road & Park Avenue, Morristown, N.J. Member 236 is molded over terminal ends of cords 226 and 238, securing them together. Optionally casing 236 and/or stiffener member 228 can be formed from molded plastic or some other suitable material, including any of a number of cord ends available from NIFCO, as noted above.

Figure 10:
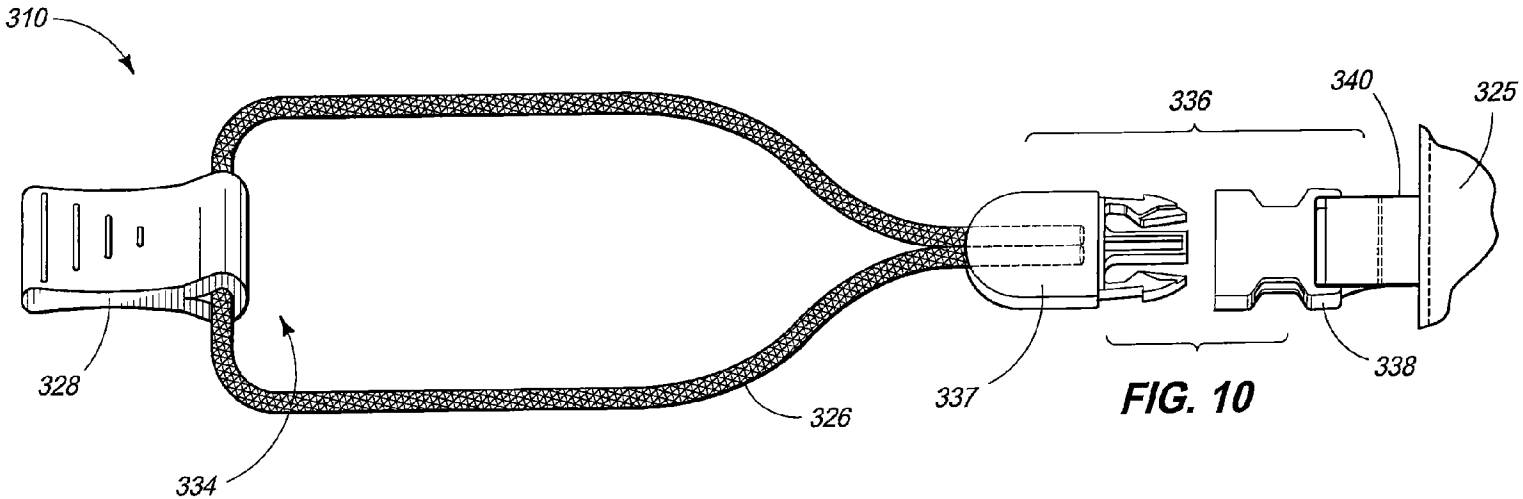
FIG. 10 is yet another optional construction lanyard having an elastic loop with a rubber molded "puller-style" stiffener member and a side-squeeze buckle assembly removably joined to a clothing seam via a sewn clothing web.

FIG. 10 is yet another optional construction lanyard 310 having an elastic shock cord loop 326 with a rubber molded "puller-style" stiffener member 328 and a side-squeeze buckle assembly 336 removably joined with male and female members 337 and 338, respectively, to a seam of a clothing panel 325 on a watersport clothing article via a sewn clothing web 340. More particularly, terminal ends of cord 326 are joined together within male member 337 of buckle assembly 336. Member 328 provides stiffening that helps hold open an aperture 334 in loop 326. According to this construction, cord 326, member 328, and male member 337 of lanyard 310 can be removed from a watersport clothing article by unbuckling buckle assembly 336.

Figure 11:
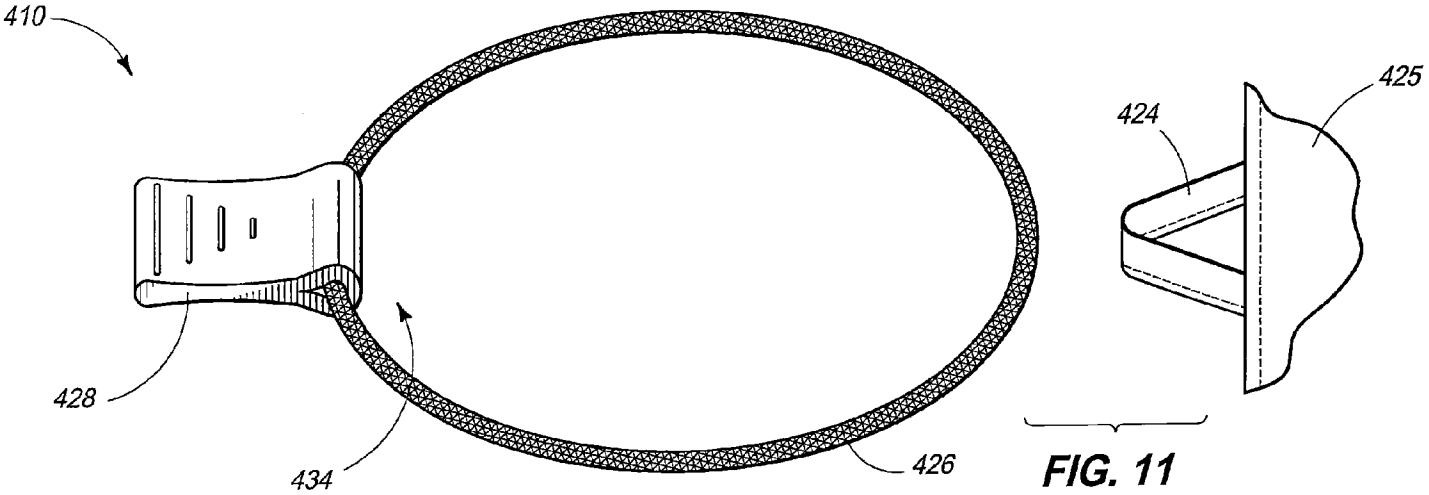
FIG. 11 is even another optional construction lanyard having an elastic loop with a rubber molded pull tab stiffener member.

FIG. 11 is even another optional construction lanyard 410 having an elastic shock cord loop 426 with a rubber molded pull tab stiffener member 428. Member 434 secures together opposed ends of cord 426 to provide a loop that is secured to a clothing web anchor 424 on a clothing element 425 of a watersport clothing article via a cows hitch knot (not shown).

Figure 12:
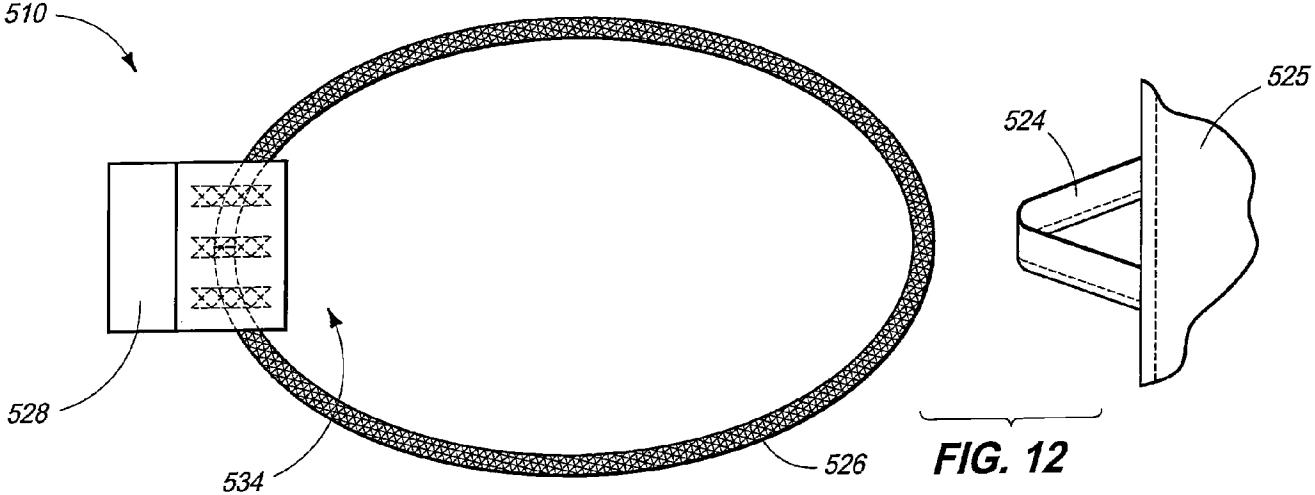
FIG. 12 is a yet even another optional construction lanyard having a sewn fabric tape stiffener member.

FIG. 12 is a yet even another optional construction lanyard 510 having a sewn clothing tape stiffener member 528. Member 528 is a piece of clothing tape, or webbing that is folded over ends of cord 526 and stitched, or bar tacked to retain ends of cord 526 into a loop having an opening, or aperture 534. Elastic shock cord 526 is then secured to clothing web 524 on panel 525 using a cows hitch knot, or some other suitable knot.

Figure 13:
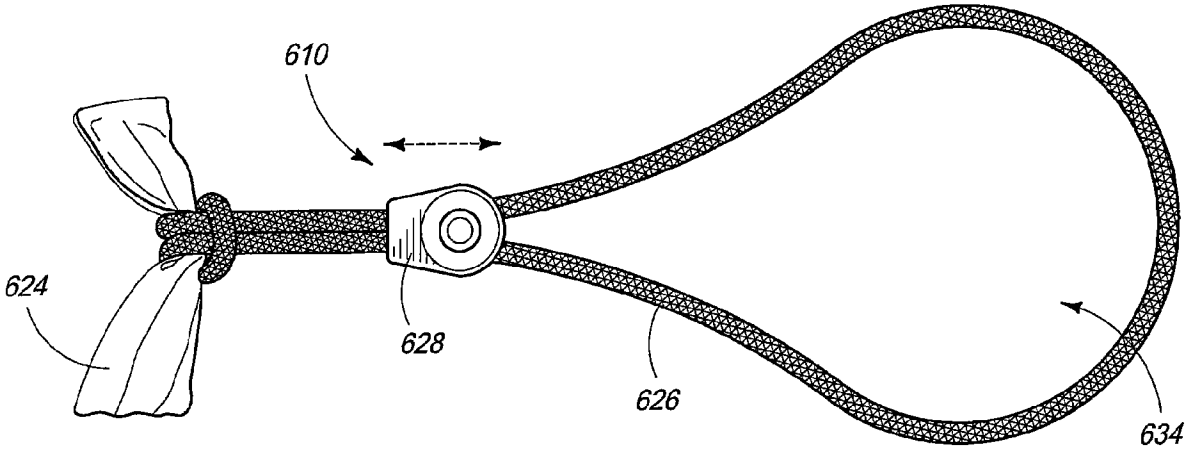
FIG. 13 is a still another optional construction lanyard having a sliding cord lock provided on a cord loop.

FIG. 13 is a still another optional construction lanyard 610 having a repositionable, or sliding cord lock 628 provided on a cord loop 626. Such a cord lock 628 can be locked into a desired position along loop 626. In one case, cord loop 626 is formed from a loop of elastic shock cord that has opposed ends either fused, sewn, or glued together. In another case, cord loop 626 is formed from a substantially inelastic piece of cord. One suitable cord lock is a NIFCO CL75A Cord Lock, available from NIFCO America Corp, Office for Nifco Group Buckle Business, 125 Baker St. E., Suite 115 Costa Mesa, Calif. 92626 U.S.A. One end of cord loop 626 is secured onto a clothing web anchor 624 on a watersport clothing article using a cows hitch knot. Cord lock 628 is slide towards anchor 624 to enlarge a loop aperture 634 when inserting a paddle handle and shaft, then slid away from anchor 624 to retain a paddle therein.

Figure 14:
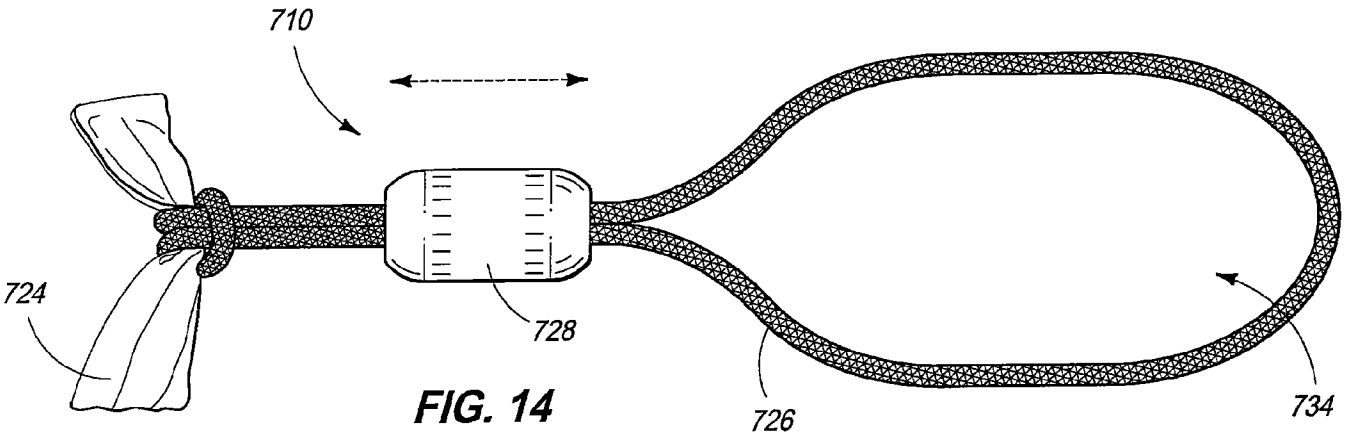
FIG. 14 is yet still another optional construction lanyard having a frictionably sliding bobbin provided on a cord loop.

FIG. 14 is yet still another optional construction lanyard 710 having a frictionably sliding bobbin 728 provided on a cord loop 726. More particularly, bobbin 728 is a plastic or semi-rigid rubber bobbin having an axial hole sized to frictionably receive opposed segments of cord 726 there through in a manner that requires a user to urge bobbin 728 along the two sections of cord 726 in order to enlarge and ensmall aperture 734 formed in cord 726 when inserting and securing a paddle handle therein. Cord 726 is secured onto a clothing web anchor 724 affixed to a watersport clothing article. Pocket 822 is shown open with lanyard 710 withdrawn from pocket 822 where it is stored when not in use.

Figure 15:
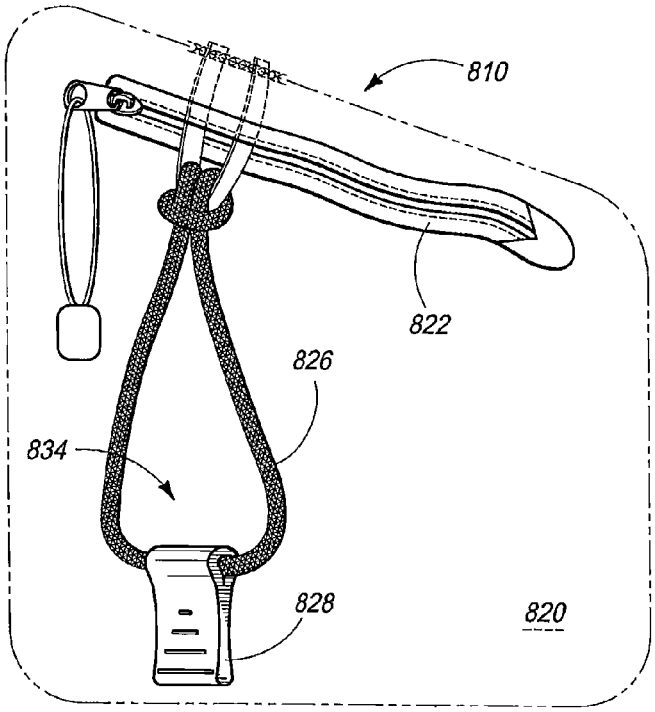
FIG. 15 is a yet further optional construction lanyard having a rubber molded pull tab stiffener member on an elastic loop affixed with a cows hitch to a clothing loop sewn inside a pocket of a clothing article along a clothing seam.

FIG. 15 is a yet further optional construction lanyard 810 having a rubber molded pull tab stiffener member 828 on an elastic shock cord loop 826 affixed with a cows hitch to a clothing loop sewn inside a pocket 822 of a clothing article along a clothing seam. Stiffener member 828 assists in holding open an aperture 834 in cord loop 826 that helps facilitate insertion and removal of a paddle handle and shaft within loop 834 of cord 826. Pocket 822 is provided on a clothing panel 820. In one case clothing panel 820 is integrated into a clothing article. In another case, clothing panel is adhesively bonded onto a clothing article, such as by adhesively bonding panel 820 onto an exterior of a wetsuit.

Figure 16:
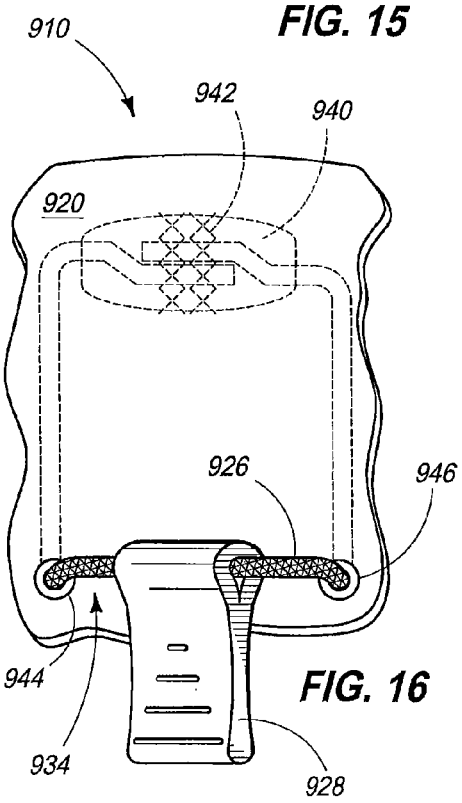
FIG. 16 is a further optional construction lanyard having a rubber molded pull tab stiffener member on a shock cord loop exiting a clothing panel through a pair of enforced apertures with a sewn clothing connector affixed beneath the clothing panel.

FIG. 16 is a further optional construction lanyard 910 having a rubber molded pull tab stiffener member 928 secured onto a shock cord loop 926 exiting a clothing panel 920 through a pair of enforced apertures 944 and 946 with a sewn clothing connector, or sewn folded clothing web 940 affixed beneath the clothing panel 940 with adhesive. Fabric connector 940 is sewn, or bar tacked over opposed ends of cord 926, securing cord 926 into a loop 934. According to one construction, panel 920 is a synthetic clothing panel, and enforced apertures 944 and 946 are formed in panel by melting, or laser cutting apertures into panel 920, forming a pool of melted material that enforces the resulting apertures 944 and 946. According to one alternative construction, apertures 944 and 946 are formed with a size slightly smaller than an outer diameter of cord 926 so as to provide frictionably-sliding restraint of cord 926 through apertures 944 and 946. According to another alternative construction, a hole is punched through panel 920 and a silicon or rubber adhesive material is provided around the hole for enforcement. Furthermore, web 940 is adhered beneath panel 920 spaced apart from apertures 944 and 946 in order to provide an extra length of shock cord 926 capable of stretching when inserting a paddle handle through aperture 934.

Figure 17:
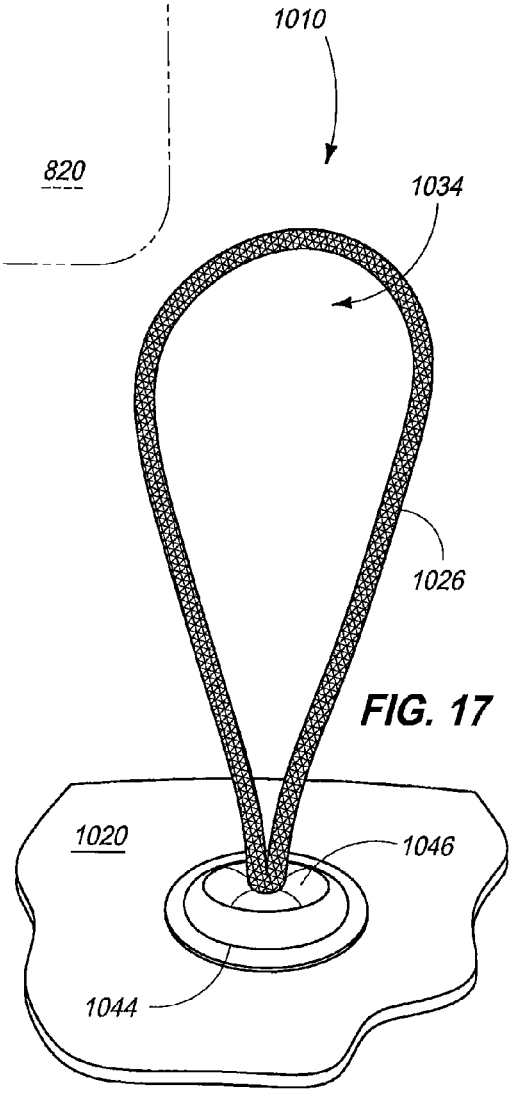
FIG. 17 is a yet further optional construction lanyard having a frictionable grommet retainer through which a cord passes for adjustably sizing a loop in the cord.

FIG. 17 is a yet further optional construction lanyard 1010 having a frictionable grommet retainer 1044 through which an elastic shock cord 1026 passes through for adjustably sizing a loop 1034 in the cord 1026. Retainer 1044 is secured in an aperture formed in clothing panel 1020. An ensmalled aperture 1046 is provided in retainer 1044 that frictionably retains opposed segments of cord 1026 as they pass there through for urged slidable retention. According to one construction, a knot is provided on a back segment of cord 1026, beneath panel 1020 to limit the size of aperture 1034 to a desirable dimension. Repositioning of the knot enables adjustment of the size of aperture 1034. One suitable cord lock is a NIFCO ELS1A Cord Lock, available from NIFCO America Corp, Office for Nifco Group Buckle Business, 125 Baker St. E., Suite 115 Costa Mesa, Calif. 92626 U.S.A.

Figure 18:
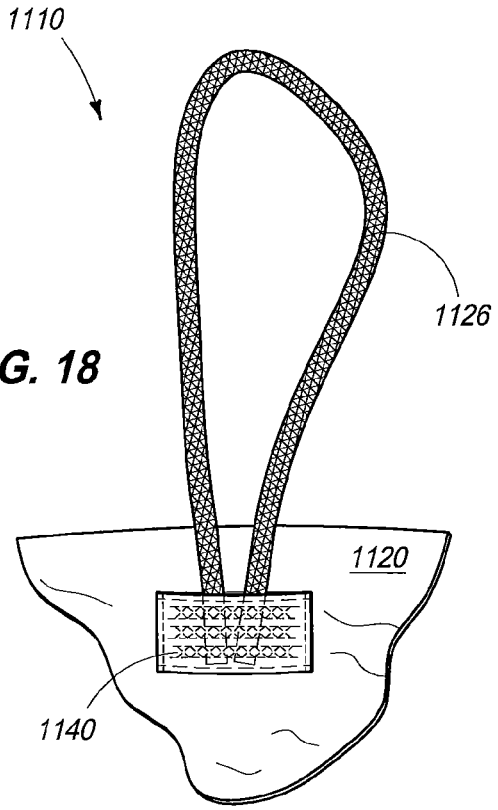
FIG. 18 is yet even another optional construction lanyard of an elastic loop having terminal ends sewn beneath a clothing patch that is then adhesively affixed to a clothing panel.

FIG. 18 is yet even another optional construction lanyard 1110 of an elastic loop 1126 having terminal ends sewn to a bottom surface of a clothing patch 1140 that is then adhesively affixed to a clothing panel 1120. Optionally, patch 1140 can be adhesively glued to a neoprene wetsuit panel. Further optionally, patch 1140 can be sewn to a clothing panel of a watersport clothing article.

Figure 19:
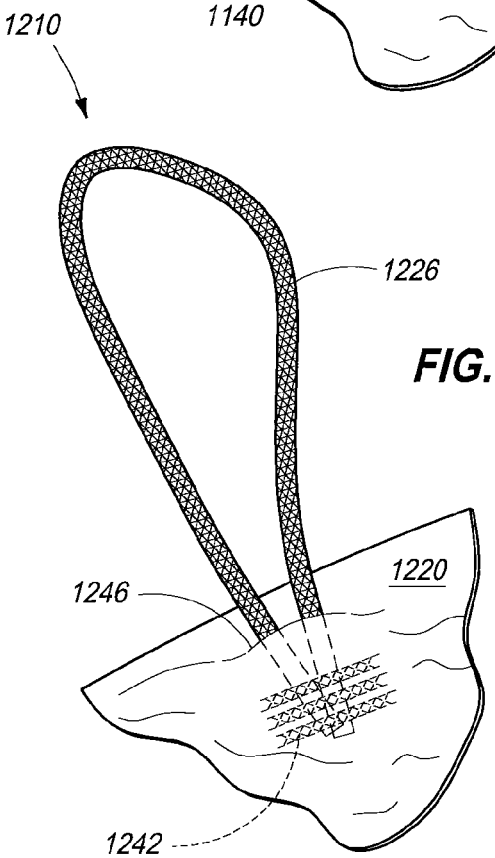
FIG. 19 is still a further optional construction lanyard of an elastic loop extending through an aperture or slit in a clothing panel and having terminal ends sewn or bar tacked to an inside surface of the clothing panel.

FIG. 19 is still a further optional construction lanyard 1210 of an elastic loop 1226 extending through an aperture or slit 1246 in a clothing panel 1220 and having terminal ends sewn or bar tacked with stitches 1242 to an inside surface of the clothing panel, or to a clothing element provided beneath clothing panel 1220. Optionally, lanyard 1210 can be stitched directly to a fabric seam on a clothing article.

Figure 20:
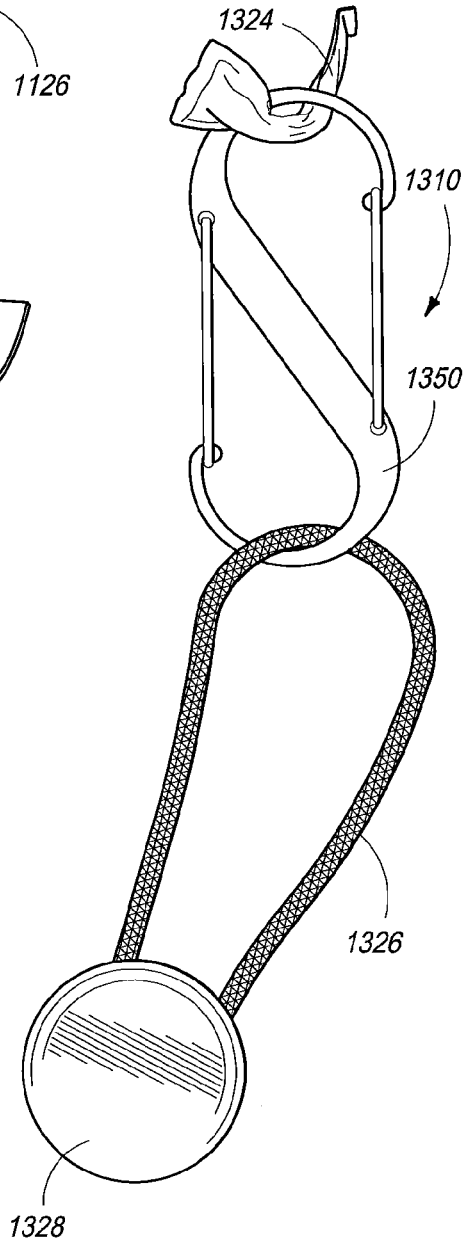
FIG. 20 is an even further optional construction lanyard similar to the construction in FIG. 9, but using a gated carabiner to mount the lanyard onto a clothing loop of a clothing article.

FIG. 20 is an even further optional construction lanyard 1310 similar to the construction in FIG. 9, but using a gated carabiner 1350 to mount lanyard 1310 (essentially the same as lanyard 110 in FIG. 8) onto a clothing loop 1324 sewn to a clothing article. According to one construction, lanyard 1310 includes a plastic "puller-style" end connector 1328 used to secure together opposed ends of elastic shock cord 1326.

Figure 21:
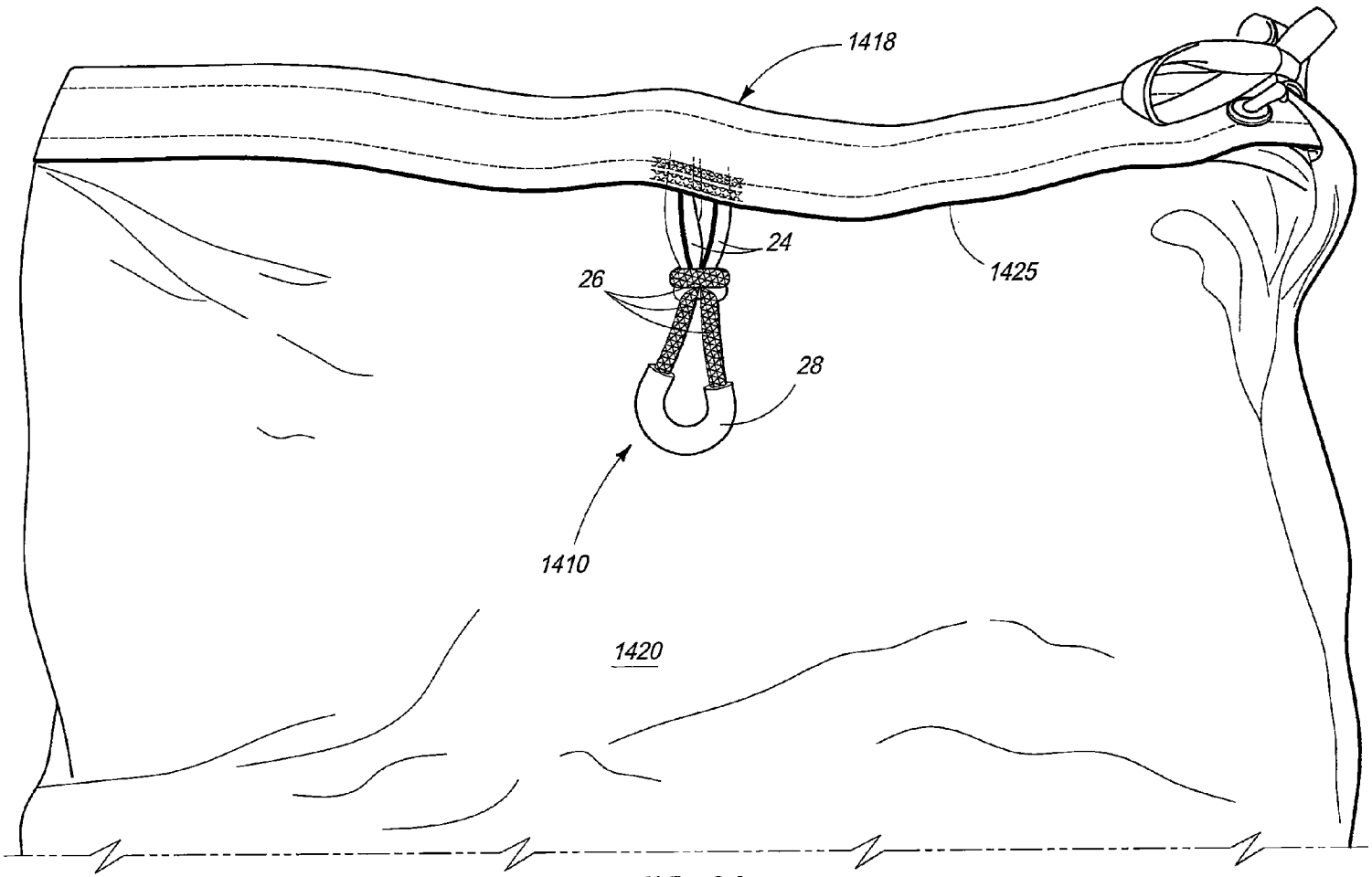
FIG. 21 is an optional construction clothing article in the form of lightweight quick-dry shorts having an external clothing loop sewn into a waistband with the elastic loop of FIG. 7 affixed to the clothing loop with a cows hitch.

FIG. 21 is an optional construction clothing article 1418 in the form of lightweight quick-dry shorts having a lanyard 1410 comprising an external clothing loop, or anchor 24 sewn into a waistband 1425 and using the elastic loop 26 of FIG. 7 affixed to the clothing loop 24 with a cows hitch. Anchor 24 is sewn to a seam between clothing panel 1420 and waistband 1425.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A watersport clothing article and paddle holder, comprising:

a clothing element provided on a lateral location of a user elevationally between an illiac crest region and a hip joint region;

an anchor provided on the clothing element; and a lanyard having a loop, a fastening, and a tactile stiffening member having a local stiffening segment affixed along the segment of the loop opposite the fastening, having a coefficient of friction higher than a coefficient of friction of the loop and configured and arranged to provide a tactile engagement surface for a user enlarging the loop and a grip for retaining a received paddle, the tactile stiffening member extending along a portion of the loop configured to impart an open aperture to the loop, the loop adjustably sized to be enlarged to receive an enlarged head of a paddle and ensmalled after being received over the head of the paddle to entrap the paddle within the loop, and the fastening secured to the anchor.

2. The watersport clothing article and paddle holder of claim 1, wherein the fastening comprises a cow hitch knot formed in the loop.

3. The watersport clothing article and paddle holder of claim 1, further comprising a repositionable cord lock encompassing a midsegment of the loop and repositionable along the midsegment of the loop to enlarge and ensmall the loop.

4. The watersport clothing article and paddle holder of claim 3, wherein the loop comprises an elastic cord capable of being stretched to enlarge the loop to receive the enlarged head of the paddle.

5. The watersport clothing article and paddle holder of claim 3, wherein the loop comprises an inelastic element.

6. The watersport clothing article and paddle holder of claim 5, wherein the inelastic element is a synthetic cord.

7. The watersport clothing article and paddle holder of claim 1, wherein the fastening is an inelastic connector.

8. The watersport clothing article and paddle holder of claim 7, wherein the inelastic connector comprises a carabiner.

9. The watersport clothing article and paddle holder of claim 7, wherein the inelastic connector comprises a male and female buckle assembly.

10. The watersport clothing article and paddle holder of claim 7, wherein the inelastic connector comprises a cows hitch formed in an inelastic segment of cord provided by the inelastic element.

11. The watersport clothing article and paddle holder of claim 1, wherein the tactile stiffening member comprises an arcuate tactile stiffening member of frictionable rubber material affixed along a segment of the loop for finger engagement by a user.

12. The watersport clothing article and paddle holder of claim 1, wherein the anchor comprises a clothing loop affixed to the clothing.

13. The watersport clothing article and paddle holder of claim 12, wherein the clothing loop is affixed to the clothing element with stitches.

14. The watersport clothing article and paddle holder of claim 12, wherein the clothing loop is affixed to the clothing element with an adhesive patch.

15. The watersport clothing article and paddle holder of claim 1, wherein the anchor comprises a clothing edge seam, and the fastening comprises stitches configured to affix the lanyard to the seam.

16. The watersport clothing article and paddle holder of claim 15, further comprising a clothing patch, the clothing edge seam provided on the patch, and the clothing patch configured to be affixed onto a panel of a clothing article.

17. The watersport clothing article and paddle holder of claim 1, wherein the anchor comprises at least one grommet affixed to the clothing element.

18. The watersport clothing article and paddle holder of claim 17, wherein the fastening comprises a segment of the lanyard extending through the grommet.

19. The watersport clothing article and paddle holder of claim 18, wherein an enlarged knot is formed in the lanyard segment beneath the grommet so as to limit withdrawal of the lanyard through the grommet.

20. The watersport clothing article and paddle holder of claim 18, wherein a pair of grommets are affixed to the clothing element, and opposed legs in the loop of the lanyard each extend through a respective one of the grommets.

21. The watersport clothing article and paddle holder of claim 1, wherein the loop comprises an elastic cord and the tactile stiffening member comprises the elastic cord.

22. The watersport clothing article and paddle holder of claim 1, wherein the clothing element comprises a clothing panel provided on a lateral region of a beach short clothing garment.

23. A paddle holder capable of being affixed to an anchor on a clothing element of a watersport article, comprising:

a lanyard having a retention device and an adapter, the adapter configured to affix to the anchor on the clothing element and the retention device comprising an elastic cord and a tactile stiffening member a segment of rubber-like material affixed to the elastic cord having a coefficient of friction greater than the elastic cord, the tactile stiffening member communicating with the cord and configured to impart an open aperture to the cord, and configured to mate and demate with a handle of a paddle to retain the paddle to the clothing element.

24. The paddle holder of claim 23, further comprising, a clothing element configured to be integrated into a watersport article along a lateral location of a user between an illiac crest region and a hip joint region; and an anchor affixed to the clothing element.

25. The paddle holder of claim 24, wherein the anchor comprises a clothing loop sewn to the clothing element and the adapter comprises stitches.

26. The paddle holder of claim 25, wherein the lanyard further comprises a self-looping cord affixed to the clothing loop with a cows hitch.

27. The paddle holder of claim 23, wherein the tactile stiffening member comprises an arcuate, tubular piece of frictionable rubber.

28. A paddle holder capable of being affixed to an anchor on a clothing element of a watersport article, comprising:

a lanyard having a retention device and an adapter, the adapter configured to affix to the anchor on the clothing element and the retention device comprising an elastic cord and a tactile stiffening member communicating with the elastic cord, the tactile stiffening member having a coefficient of friction greater than a coefficient of friction for the elastic cord and configured to impart an open aperture to the cord and mate and demate with a handle of a paddle to retain the paddle to the clothing element.

29. The paddle holder of claim 28, wherein the tactile stiffening member comprises a synthetic material.

30. The paddle holder of claim 29, wherein the tactile stiffening member comprises a natural rubber material.

* * * * *